United States Patent [19]

Yamamura

[11] 4,024,676

[45] May 24, 1977

[54] ELECTRONIC TIMEPIECE

[75] Inventor: Katsumi Yamamura, Suwa, Japan

[73] Assignee: Kabushiki Kaisha Suwa Seikosha, Tokyo, Japan

[22] Filed: June 13, 1975

[21] Appl. No.: 586,675

Related U.S. Application Data

[63] Continuation-in-part of Ser. No. 399,039, Sept. 24, 1973, abandoned, which is a continuation-in-part of Ser. No. 178,962, Sept. 9, 1971, abandoned.

[30] Foreign Application Priority Data

Sept. 12, 1970 Japan ..... 45-79659

[52] U.S. Cl. ..... 58/23 A; 58/50 R; 58/85.5

[51] Int. Cl.[2] ..... G04C 3/00; G04B 19/30; G04B 27/00

[58] Field of Search ..... 58/23 R, 50 R, 85.5

[56] References Cited

UNITED STATES PATENTS

| | | | |
|---|---|---|---|
| 3,505,804 | 4/1970 | Hofstein | 58/23 R |
| 3,672,155 | 6/1972 | Bergey et al. | 58/50 R |
| 3,810,356 | 5/1974 | Fujita | 58/23 R |
| 3,852,952 | 12/1974 | Uittoz et al. | 58/50 R X |

OTHER PUBLICATIONS

Kaiser et al., "Recent Developments in CMOS/SOS", RCA Engineer, Aug. 1972, pp. 68–72.

Burgess, R. R., Daniels, R. G., "C/MOS United with Silicon Gate to Yield Micropower Technology," Electronics, Aug. 30, 1971, pp. 38–43.

*Primary Examiner*—E. S. Jackmon

*Attorney, Agent, or Firm*—Blum, Moscovitz, Friedman & Kaplan

[57] ABSTRACT

An electronic timepiece wherein a quartz crystal oscillator produces a timekeeping standard signal which is divided by a transformer means formed of silicon gate complementary MOS transistor elements. The output of the transfer means is applied to a drive circuit which in turn is coupled to a digital display formed of liquid crystal elements. Time correction is performed by two switches, one switch selecting the digit of the display to be corrected, the other correcting the number displayed at the selected digit.

7 Claims, 17 Drawing Figures

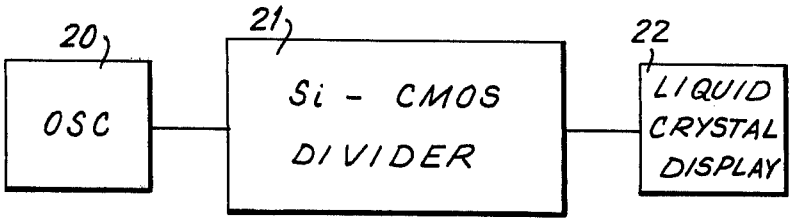
FIG. 8
FIG. 9
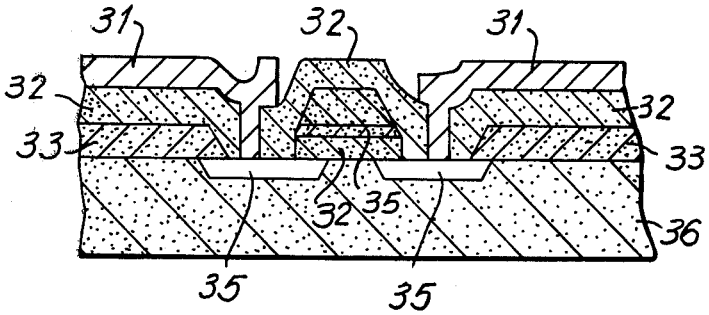
FIG. 10
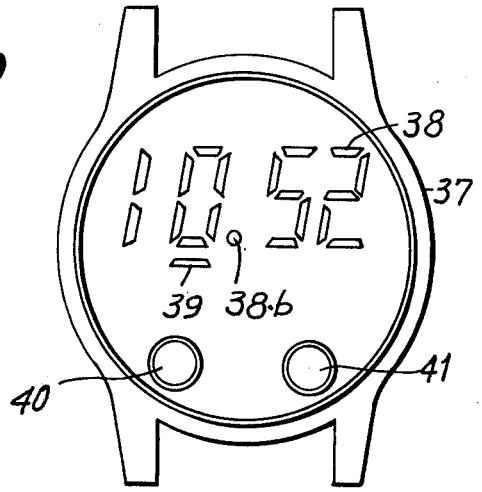

ELECTRONIC TIMEPIECE

CROSS REFERENCE TO RELATED APPLICATION

This application is a continuation-in-part of my application Ser. No. 399,039, filed Sept. 24, 1973 which is now abandoned, which was a continuation-in-part of my application Ser. No. 178,962 filed on Sept. 9, 1971 which is now abandoned.

BACKGROUND OF THE INVENTION

This invention relates to electronic wrist watches without mechanical dividers. Heretofore, conventional quartz crystal wrist watch have incorporated electromechanical transformers for converting an electrical driving signal to the mechanical indexing of a gear train and set of hands. Such arrangements draw a substantial amount of power, increasing the size of and limiting the life of the battery provided for driving the wrist watch.

Accordingly, it is desirable to provide a divider and circuit arrangement capable of operating at low voltage levels.

SUMMARY OF THE INVENTION

Generally speaking, in accordance with the invention, an electronic timepiece is provided having a quartz crystal oscillator for producing a time standard signal, a signal transfer means for dividing said time standard signal, said signal transfer means being formed of MOST's (metal oxide semiconductor transistors), a driving circuit for receiving the output of said signal transfer means, and a liquid or solid display element driven by said driving circuit for displaying time in a digital form.

The MOST's are preferably silicon gate MOS field effect transistors, which transistors require less power and hence operate at lower voltage levels. The display is preferably a digital display comprised of crystal cells.

Time correction is performed by two switches, one switch selecting the digital of the display to be corrected, the other correcting the number displayed at the selected digit. A liquid crystal display element associated with each digit to be corrected is energized by the selection switch to provide an indication of the selected digit.

Accordingly, it is an object of this invention to provide an electronic timepiece with a digital display means in which power consumption is minimal.

Another object of this invention is to provide divider circuitry having a low power consumption and being includable in a small sized electronic timepiece such as a wrist watch.

Still another object of this invention is to provide an improved electronic timepiece having substantially all the electronic circuitry therein formed by integrating techniques.

Still a further object of this invention is to provide a digital display timepiece wherein a multi-digit display may be corrected by the operation of any two switches.

Still other objects and advantages of the invention will in part be obvious and will in part be apparent from the specification and drawings.

The invention accordingly comprises the features of constructions, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompany drawings, in which:

FIG. 8 is a block diagram of a timepiece according to the present invention;

FIG. 9 is a sectional view of a silicon gate MOST constructed in accordance with the present invention;

FIG. 10 is a perspective view of a wrist watch constructed in accordance with the present invention;

DESCRIPTION OF THE PREFERRED EMBODIMENTS

Figure 1:
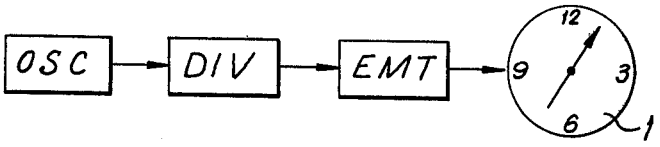
FIG. 1 PRIOR ART
FIG. 1 is a block diagram of a conventional electronic timepiece.

Referring now to FIG. 1, the conventional type of quartz crystal wrist watch schematically depicted therein includes an oscillator OSC, a frequency divider DIV and an electro-mechanical transformer EMT. The frequency divider serves to divide the output of the oscillator circuit for production of a signal which is converted to mechanical motion in the electromechanical transformer. The rotational speed of the minute and hour hands is stepped down in this embodiment by a mechanical gear train represented schematically at 1, the time being displayed in an analog form by means of an hour and a minute hand. While such analog display of time is well accepted, it is deemed that a digital display of time would be substantially more advantageous, being easier to read and more convenient.

Figure 2:
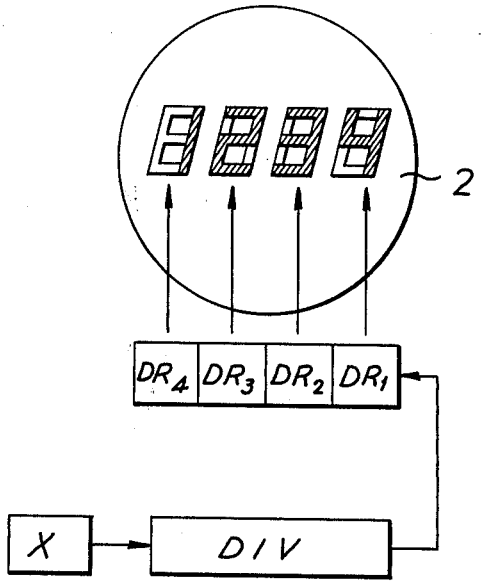
FIG. 2 is a block diagram of the timepiece according to the present invention.

An arrangement according to the invention is depicted in FIG. 2, and includes a time standard signal source X which may be a piezo-electrically or electrostrictively driven crystal oscillator. The output of said time standard signal source is applied to a transformer means DIV which divides the oscillator signal through the use of field effect transistors such as metal oxide semiconductor transistors (MOST). Said transfer means only serves to transform the time signal to a lower frequency, and not to transform the electrical power energy. Accordingly, said transfer means consumes a minimum of power as compared with current-operated bipolar type transistors which consume relatively large amounts of power. The display arrangement according to the invention consists of a display cell 2 which, in the embodiment depicted, consists of four digits, each digit defined by a seven-bar display, said display elements being formed of solid luminous elements wherein light radiates from the junction of two elements such as gallium and arsenic upon the application of a signal thereto, or a liquid crystal display device wherein the absorption and reflection of light are changed by the application of an electric field thereto. Accordingly, the display cell does not incorporate any mechanical parts, but does generally require the use of a bipolar transistor in the drive circuit thereof in view of the amount of electrical energy required for driving the display elements. However, a driving circuit formed only of MOST elements can be used where the display cell has a high input impedance, such as in the case of a liquid crystal cell. Thus, the output of the transformer means DIV is applied to four drive circuits $DR_1$, $DR_2$, $DR_3$ and $DR_4$, one of is associated with each digit of the display cell 2.

Figure 3:
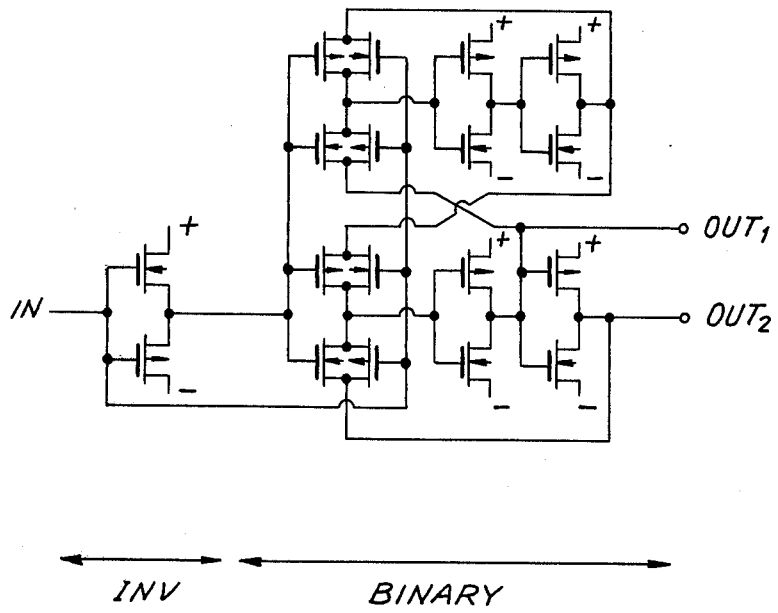
FIG. 3 is a circuit diagram of a section of the divider circuitry according to the invention.

Referring now to FIG. 3, one embodiment of a section of the divider circuit according to the invention is depicted. Said divider circuit is formed of MOST elements and consists of an inverter stage and a binary divider stage for dividing the fequency of the input signal.

Figure 4B:
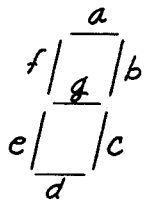
FIG. 4*a* is a circuit diagram of a driving circuit according to the invention for producing the seven bar display depicted in FIG. 4*b;*
Figure 4A:
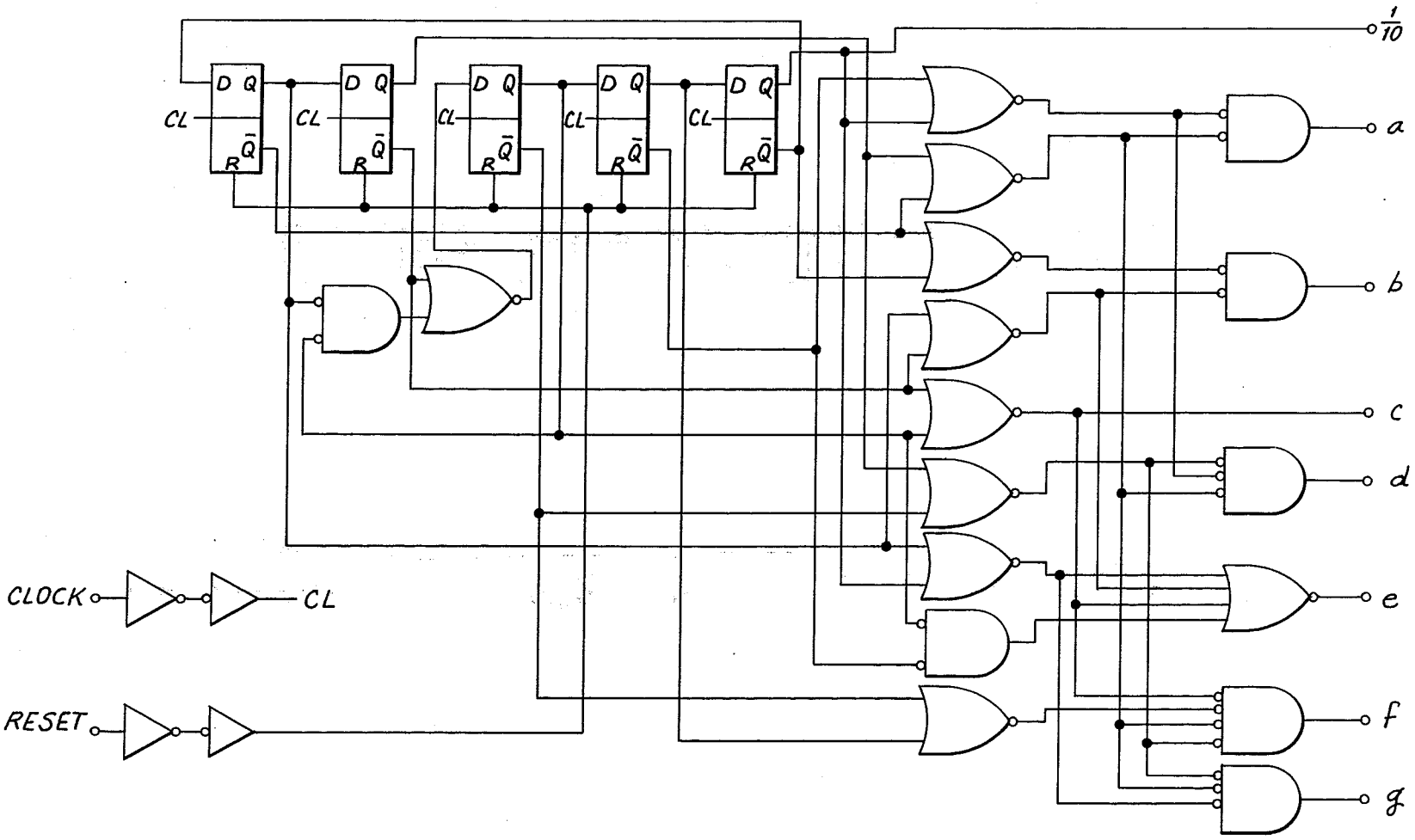

FIG. 4*a* shows one embodiment of a driver circuit according to the invention which consists of a series of counter elements and a logic decoder for the selective actuation of one or more of the bars defining the seven bar display as more particularly shown in FIG. 4*b*. Thus, if the digit driven by the circuit of FIG. 4*a* is required to display a numeral 4, then the bars of display elements *b*, *c*, *f* and *g* would be actuated by means of signals generated at the associated output gates through the counters and logic decoder. In this manner, a digital output display is produced.

Figure 5A:
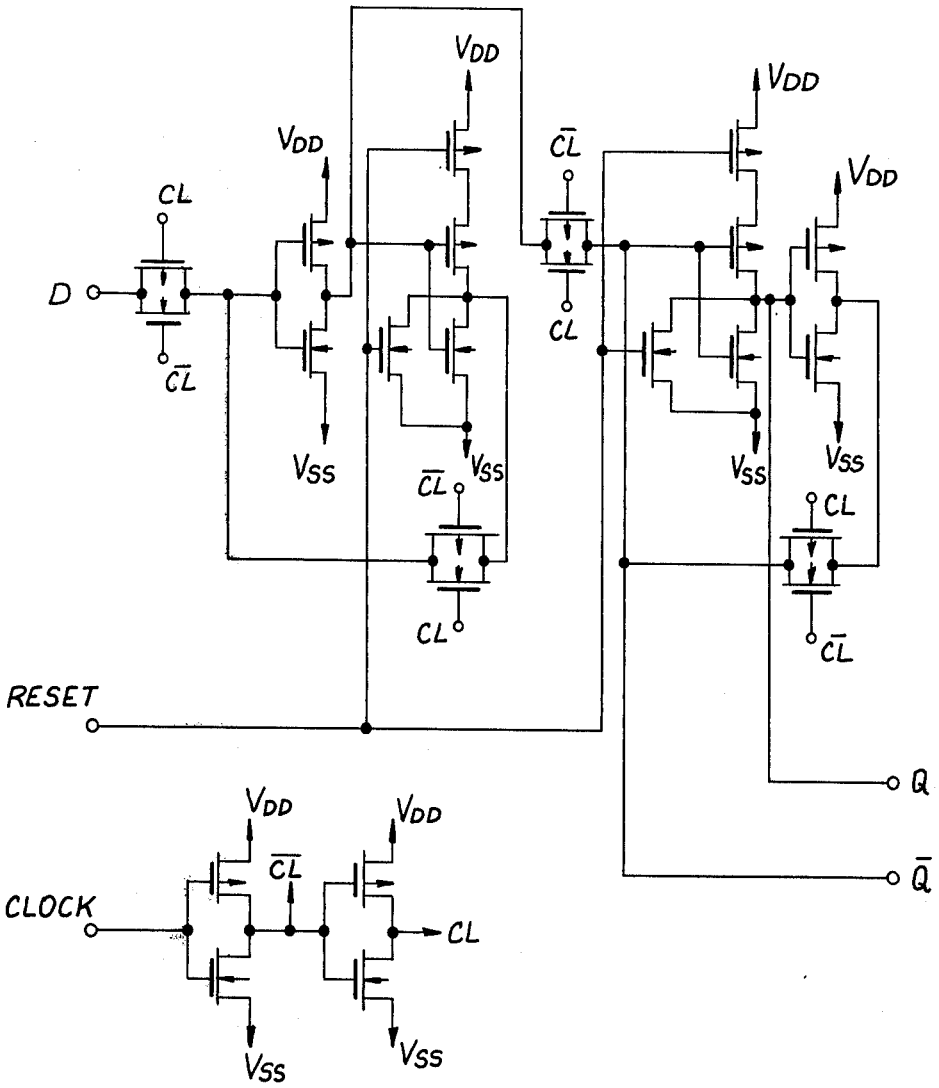
FIG. 5*a* is a circuit diagram of a section of the counter depicted in FIG. 5*b;*
Figure 5B:
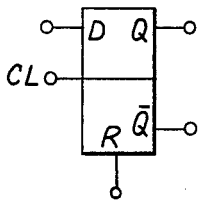

FIG. 5*a* shows a circuit diagram of one embodiment of the counter element depicted schematically in FIG. 5*b*, and incorporated in the driver circuit of FIG. 4*a*, said circuit being formed from MOST elements.

Figure 6A:
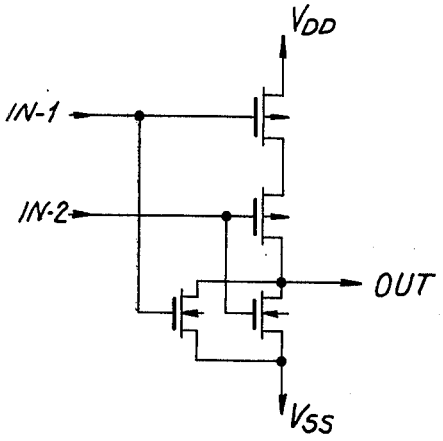
FIG. 6*a* is a circuit diagram of an OR circuit of the type depicted in FIG. 6*b;*
Figure 6B:
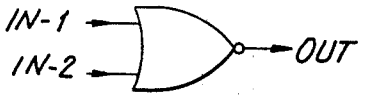
Figure 7A:
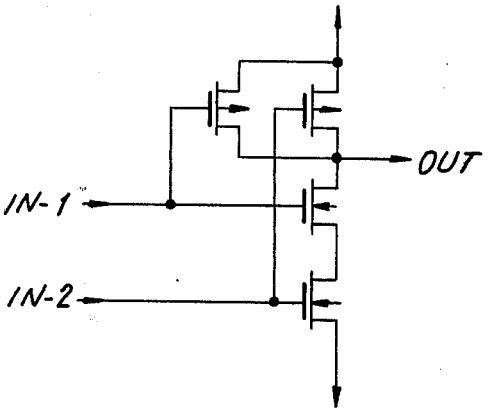
FIG. 7*a* is a circuit diagram of an AND circuit of the type depicted in FIG. 7*b;*
Figure 7B:
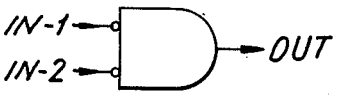

FIG. 6*a* depicts an OR circuit utilizing complementary MOST as depicted schematically in FIG. 6*b*. Similarly, FIG. 7*a* depicts an AND circuit utilizing complementary MOST as depicted schematically in FIG. 7*b*. The OR and AND circuits of FIGS. 6 and 7 could be incorporated in the driver circuits of FIG. 4*a*. Through the use of the above-described circuitry, a watch having a digital display may be produced drawing a minimum amount of electrical energy. Through the use of MOST circuit elements, electrical energy is only used for the time display device, energy not being consumed in the dividing circuitry and transfer means.

A preferred embodiment of an electronic timepiece having divider circuitry comprising silicon gate MOS transistors is depicted in FIGS. 8 through 12. Referring specifically to FIG. 8, a block diagram of an electronic timepiece is depicted including a quartz crystal oscillator 20 for supplying a high frequency signal to a divider network 21 entirely formed of complementary coupled silicon gate MOS transistors. The divider circuit 21 is coupled to a liquid crystal display 22 to supply low frequency timekeeping signals to the display 22 to effect a light scattering and hence a digital display in response to the electric field applied thereto. The use of silicon gate complementary MOS field effect transistors, hereinafter referred to as Si-CMOST provides the following advantages:

1. Si-CMOST's have low threshold voltages $V_{th}$ and hence lower voltage is required than if conventional aluminum electrode MOST's are utilized;
2. Si-CMOST's are formed by a self-aligning method so that the source and drain with the use of the gate as an electrode so that the overlapped portion of the gate electrode and the source or drain electrodes respectively is only the transverse diffusing distance, thus greatly reducing the capacitance between the electrodes to thereby greatly improve the switching speed of the MOS, and hence reducing the current required; and
3. Because resistors can be made by diffusion techniques, a complete electronic timepiece circuit including Si-CMOST can be manufactured as an integrated circuit.

A silicon gate MOST of the type utilized in the novel electronic circuit depicted in FIG. 8 is illustrated in FIG. 9. A substrate 36 of spinel or sapphire is provided for support and insulation in the silicon gate MOST. The substrate has formed therein, a silicon layer 35 having diffused therein diffusion P-areas defining the source 35′ and drain 35″. A polycrystalline silicon layer 33 on silicon layer 35 surrounds the source, drain and gate regions. Overlapping said polycrystalline silicon layer and also contacting each of said source 35′ and drain 35″ is a silicon dioxide ($SiO_2$) layer 32. Aluminum electrodes 31 engage each of said source 35′ and drain 35″. In the gate region, a silicon oxide layer 32′ is covered by a layer of $Si_3N_4$ 34 which is itself covered a polycrystalline silicon layer 33′. The combination of silicon oxide layer 32′, $Si_3N_4$ layer 34 and polycrystalline silicon layer 33′ are surrounded by a silicon oxide layer 32″. When the silicon gate concept is utilized, a substrate which is provided as an insulator need only have a relatively low specific resistance so that leakage is increased between the source or drain area and the substrate. The gate portion of such MOS transistors have extremely low power requirements. Since in the MOST in accordance with the invention, the silicon is grown on sapphire or spinel substrates in order to prevent the leakage between the source or drain portions and the substrate, the source and drain portions also have minimal power requirements. Thus, the manufacturing technique referred to as SOS (silicon on sapphire) can be utilized for forming such elements.

An electronic wrist watch including the Si-CMOST integrated circuitry depicted in FIGS. 8 and 9 is depicted in FIG. 10. The electronic circuitry is held within a case 37. The liquid crystal time display 38 includes a point 38*b* between the hours and minute displays. A further bar 39 is provided beneath each digit of time, only one of which is shown as being visible, for use in time correction. Selection switch 40 is disposed on the face of the wrist watch underneath the hours display and is used to select the digit to be corrected, the selected digit being indicated by bar 39. Correction switch 41 is provided for effecting correction of the selected digit. By pushing switch 41 once, the number displayed is indexed quickly one by one until the correct number is displayed. Selection switch 40 is then operated to move bar 39 to the next digit (10-minute digit) and correction is effected. In this way each digit is corrected in order. If desired, switch 41 can index the selected digit once for each operation thereof.

The liquid crystal display 38 is formed from a liquid crystal material sandwiched between two electrode plates, one of the plates being segmented to define the seven bar display of each digit, point 38*b* and bars 39, the liquid crystal material regions becoming opaque when an electric field is applied to the electrodes in registration therewith and remain transparent when no electric field is applied. When Si-CMOST's are utilized, although 10–50 nanoamperes per unit segment are supplied, the whole wrist watch requires only 2–30 micro watts power consumption.

Figure 11:
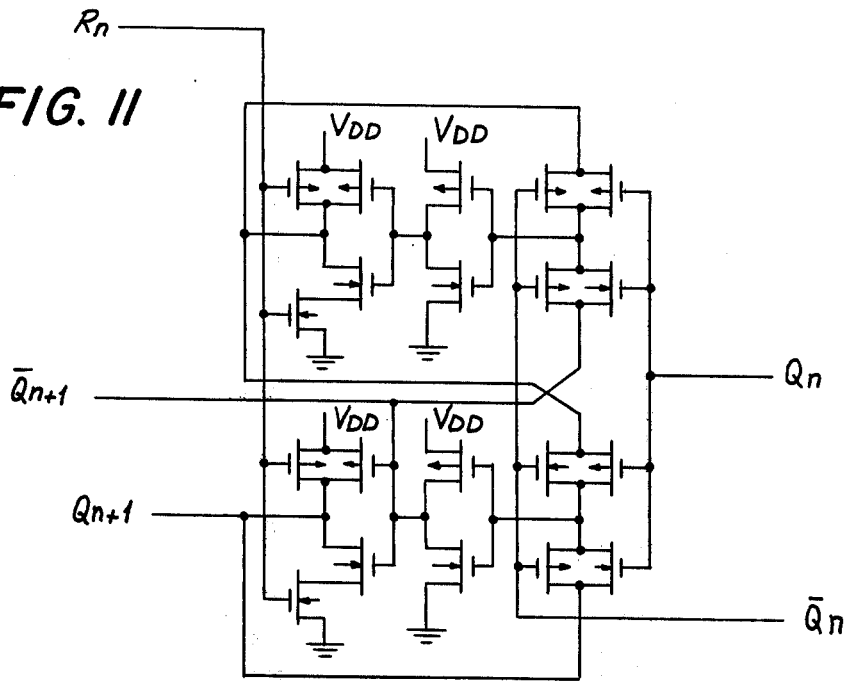
FIG. 11 is a circuit diagram of a divider circuit using complementary MOS transistors of the type utilized in the divider circuit of FIG. 8.
Figure 12:
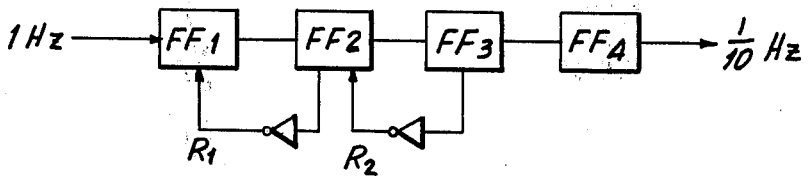
FIG. 12 is a circuit diagram of the divider circuit of the type depicted in FIG. 11 to form a one-tenth divider circuit.

Referring now to FIG. 11, a ½ flip-flop divider is depicted therein. The divider is formed of Si-CMOST's as hereinabove discussed. FIG. 12 is a block diagram of ½ flip-flop circuits depicted in FIG. 11 joined in four steps for feedback division to operate as a 1/10 divider circuit utilizing silicon gate complementary MOS transistors. The segment display is driven by distributing signals from the decimal or hexadic divider circuits to the segments of each numeric digit by means of a decoder circuit in the manner described above.

Figure 13:
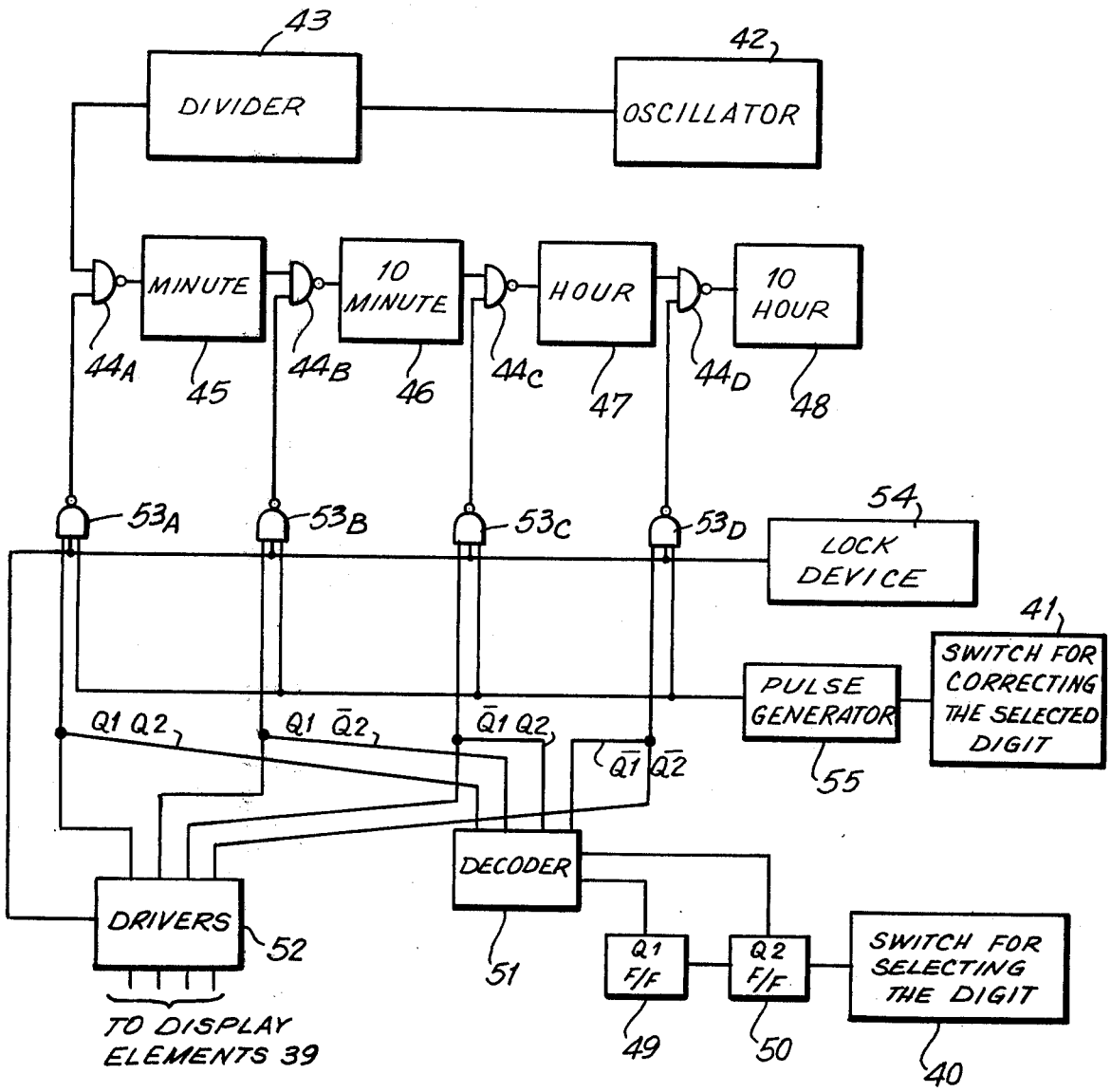
FIG. 13 is a block diagram of the time correction arrangement of the electronic timepiece of the invention.

Referring now to FIG. 13, a block diagram of the circuitry of the electronic timepiece of FIG. 10 is depicted. Oscillator 42, which may be of the quartz crystal type, produces a high frequency time standard signal which is applied to frequency divider 43, the output of which is a 1-minute signal. Said one-minute signal constitutes one of the inputs to NAND gate $44_A$. The output of NAND gate 44*a* is applied to minute counter 45, which produces a 10-minute signal which is applied as one of the inputs to NAND gate $44_B$. The output of NAND gate $44_B$ is applied to 10-minute counter 46, the output of which is an hour signal applied to one of the inputs of NAND gate $44_C$. The output of NAND gate $44_C$ is applied to hour counter 47, the output of which is a 10-hour signal applied as one of the inputs to NAND gate $44_D$. Finally, the output of NAND gate $44_D$ is applied to 10-hour counter 48. The minute, 10-minute, hour and 10-hour counters would be connected through suitable drivers to a liquid crystal display to respectively drive corresponding digits of such display such as digits 38 of FIG. 10. As more particularly described above in connection with FIG. 10, correction of the four digits is effected solely by two switches 40 and 41. Selection switch 40 actuates a pair of series-connected flip-flops 49 and 50 which respectively produce outputs of $Q_1$ and $Q_2$, the combined outputs of which represents a count of one through four, which count is decoded by decoder 51 to sequentially produce output signals on four output lines identified respectively as $Q_1Q_2$, $Q_1\overline{Q}_2$, $\overline{Q}_1Q_2$, and $\overline{Q}_1\overline{Q}_2$. The outputs of these lines are applied through suitable drivers 52 to display elements 39 to sequentially actuate such liquid crystal display elements so as to provide a visual indication of which of the digits of time has been selected for correction. Only one such liquid crystal display element 39 is actuated at any one time, depending on which of the four output lines of decoder 51 is energized. The four output lines of decoder 51 are also respectively connected to provide one input to one of four NAND gates $53_A$, $53_B$, $53_C$ and $53_D$. The output of lock device 54 provides a second input to each of NAND gates $53_A$, $53_B$, $53_C$ and $53_D$. Lock device 54 would be a two position switch mounted on the watch of FIG. 10, a first position of the switch permitting correction, and a second position of the switch disabling correction. In effect, lock device 54 serves as a safety switch so that inadvertent actuation of switches 40 and 41 will not effect correction. Correction is possible only when the lock device 54 is in a predetermined "on" position. The output of lock device 54 may also be applied to drivers 52 to disable said drivers when lock device 54 is in its "off" position thereby saving the power required to energize display segments 39 when time correction is not necessary.

The third input of NAND gates $53_A$, $53_B$, $53_C$ and $53_D$ is a common output of pulse generator 55, which is driven by correction switch 41. Each actuation of correction switch 41 produces a pulse output of pulse generator 55 which is applied to the third input of each of NAND gates $53_A$, $53_B$, $53_C$ and $53_D$. The output of NAND gates $53_A$, $53_B$, $53_C$ and $53_D$ are respectively applied as the second input to NAND gates $44_A$, $44_B$, $44_C$ and $44_D$ for the selective correction of each of minute counter 45, 10-minute counter 46, hour counter 47 and 10-hour counter 48.

The output of NAND gates $53_A$, $53_B$, $53_C$ and $53_D$ is normally "high" unless a signal is applied to all three inputs of one of said NAND gates. Such a state would exist when lock device 54 is in an "on" position, the particular NAND gate is selected by selection switch 40, and a correction pulse is applied by actuation of correction switch 41. Upon the concurrence of these three signals, the output of the selected NAND gate goes "low" and applied to the associated NAND gate $44_A$, $44_B$, $44_C$ or $44_D$. NAND gates $44_A$, $44_B$, $44_C$ and $44_D$ normally merely invert the minute, 10 minute, hour or 10 hour signal respectively applied thereto. However, when the second input to a particular one of NAND gates $44_A$, $44_B$, $44_C$ and $44_D$ from the corresponding one of NAND gates $53_A$, $53_B$, $53_C$ and $53_D$ goes low, an additional pulse is added to the input to the associated counter. In this way, one pulse is added to the counter selected by selection switch 40 for each actuation of correction switch 41 provided the lock device 54 is in the on position. Pulse generator 55 may be dispensed with if desired.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic timepiece comprising quartz crystal oscillator means for generating a time standard signal; divider circuit means for producing a plurality of timekeeping signals each corresponding to a digit of time to be displayed in response to said time standard applied thereto; liquid crystal display means for digitally displaying a plurality of digits of time in response to said timekeeping signals coupled thereto; driving circuit means intermediate said display means and said divider circuit means for coupling said timekeeping signals to said display means; and means for selectively correcting each of said plurality of digits of displayed time of said display means, said correction means being coupled to said divider means and including a manually operable selection switch, a manually operable correction switch, and selection circuit means coupled to said correction and selection switches for the selection of the digit of time to be corrected in response to the actuation of said selection switch and the transmission of a correction signal to said divider means for correcting the timekeeping signal associated with the selected digit of time, said correction signal being produced in response to the selective actuation of said correction switch, said selection circuit means including counter means for counting at least up to the number of digits to be counted, said counting means advancing one unit of said count for each actuation of said selection switch, said selection circuit means further including a gate means associated with each digit of time to be corrected, each said gate means receiving a signal representative of one of the counts of said counter means and having an output coupled to said divider means for correcting the count of the timekeeping signal associated with the associated digit of time to be corrected, said divider means including a plurality of series-connected divider stages, one of said divider stages producing each of said timekeeping signals and having an input and an output in said series connection, each said gate means including a first gate having as its input a signal representative of the count of said counter means and a signal representative of the selective energization of the correction switch, and a second gate having as its input the output of said first gate and the input of the divider stage immediately prior to the divider stage associated with the digit of time to be corrected in said series connection, the output of said second gate being applied as the input to said associated divider stage the count of which is to be corrected.

2. An electronic timepiece as recited in claim 1, wherein said first and second gates are NAND gates.

3. An electronic circuit as recited in claim 1, including manually operable lock switch means for selectively producing in a first mode a signal enabling time correction and in a second mode a signal preventing time correction, the signal output of said lock switch being applied as a third input to each of said first gates so that said first gates will pass an output only when said lock switch is in its first position.

4. An electronic timepiece as recited in claim 1, wherein said liquid crystal display includes liquid crystal display segments associated with each digit of time to be corrected, said selection circuit means including means for selectively energizing the liquid crystal display segment associated with the digit of time to be corrected to render said liquid crystal display segment visually identifiable.

5. An electronic timepiece as recited in claim 1, wherein said liquid crystal display means includes a liquid crystal display segment associated with each digit of time to be corrected, said selection circuit means including circuit means coupling said counter and said liquid crystal display segments for the selective energization of the liquid crystal display segment of the digit of time to be corrected to render only such digit visually identifiable.

6. An electronic timepiece as recited in claim 3, wherein said liquid crystal display means includes a liquid crystal display segment associated with each digit of time to be corrected, said selection circuit means including circuit means coupling said counter and said liquid crystal display segments for the selective energization of the liquid crystal display segment of the digit of time to be corrected to render only such digit visually identifiable, said circuit means coupling said counter means and liquid crystal display segments being further coupled to said lock switch for disabling when said lock switch is in its second position so that none of said liquid crystal display elements are rendered visible when said lock switch is in its second position.

7. An electronic timepiece as recited in claim 1, wherein said divider circuit means and driving circuit means are formed of Si-gate-CMOST elements.

* * * * *